8/11/87 XR 4,685,519

United States Patent [19]

Stowe et al.

[11] Patent Number: 4,685,519

[45] Date of Patent: Aug. 11, 1987

[54] HYDRAULIC FRACTURING AND GRAVEL PACKING METHOD EMPLOYING SPECIAL SAND CONTROL TECHNIQUE

[75] Inventors: Lawrence R. Stowe, Plano; Malcolm K. Strubhar, Irving, both of Tex.

[73] Assignee: Mobil Oil Corporation, New York, N.Y.

[21] Appl. No.: 729,709

[22] Filed: May 2, 1985

[51] Int. Cl.[4] ..... E21B 43/04; E21B 43/267

[52] U.S. Cl. ..... 166/278; 166/280; 166/308

[58] Field of Search ..... 166/278, 280, 281, 308, 166/51

[56] References Cited

U.S. PATENT DOCUMENTS

| | | | |
|---|---|---|---|
| 2,774,431 | 12/1956 | Sherborne | 166/280 |
| 3,434,540 | 3/1969 | Stein | 166/250 |
| 3,708,013 | 1/1973 | Dismukes | 166/276 |
| 3,756,318 | 9/1973 | Stein et al. | 166/278 |
| 3,960,366 | 6/1976 | Abney et al. | 166/51 |
| 3,983,941 | 10/1976 | Fitch | 166/276 |
| 3,987,850 | 10/1976 | Fitch | 166/254 |
| 3,999,608 | 12/1976 | Smith | 166/278 |
| 4,186,802 | 2/1980 | Perlman | 166/280 |
| 4,378,845 | 4/1983 | Medlin et al. | 166/297 |
| 4,401,158 | 8/1983 | Spencer et al. | 166/278 |
| 4,549,608 | 10/1985 | Stowe et al. | 166/280 |

*Primary Examiner*—Stephen J. Novosad
*Assistant Examiner*—Bruce M. Kisliuk
*Attorney, Agent, or Firm*—Alexander J. McKillop; Michael G. Gilman; George W. Hager, Jr.

[57] ABSTRACT

A production well is completed through a subterranean oil or gas reservoir. The well employs a well casing with perforation tunnels for fluid communication with the reservoir. A sand screen tubing is located in juxtaposition with the perforation tunnels with an annular section being formed between the casing and the sand screen tubing. A fracturing fluid and gravel packing sand is injected through the annular section and perforation tunnels into the reservoir. The injection is terminated when the fracture is complete and the perforation tunnels and annular section are filled with gravel packing sand. The oil or gas in the reservoir is then produced through the gravel packed well casing and the sand screen.

9 Claims, 6 Drawing Figures

HYDRAULIC FRACTURING AND GRAVEL PACKING METHOD EMPLOYING SPECIAL SAND CONTROL TECHNIQUE

BACKGROUND OF THE INVENTION

This invention relates to a method of completing a well that penetrates a subterranean formation and, more particularly, relates to a well completion technique for controlling the production of sand from the formation through hydraulic fracturing and gravel packing.

In the completion of wells drilled into the earth, a string of casing is normally run into the well and a cement slurry is flowed into the annulus between the casing string and the wall of the well. The cement slurry is allowed to set and form a cement sheath which bonds the string of casing to the wall of the well. Perforation tunnels are provided through the casing and cement sheath adjacent the subsurface formation.

Fluids, such as oil or gas, are produced through these perforation tunnels into the well. These produced fluids may carry entrained therein sand, particularly when the subsurface formation is an unconsolidated formation. Produced sand is undesirable for many reasons. It is abrasive to components found within the well, such as tubing, pumps, and valves, and must be removed from the produced fluids at the surface. Further, the produced sand may partially or completely clog the well, substantially inhibiting production, thereby making necessary an expensive workover. In addition, the sand flowing from the subsurface formation may leave therein a cavity which may result in caving of the formation and collapse of the casing.

In order to limit sand production, various techniques have been employed for preventing formation sands from entering the production stream. One such technique, commonly termed "gravel packing", involves the forming of a gravel pack in the well adjacent the entire portion of the formation exposed to the well to form a gravel filter. In a cased perforated well, the gravel may be placed inside the casing adjacent the perforation tunnels to form an inside-the-casing gravel pack or may be placed outside the casing and adjacent the formation or may be placed both inside and outside the casing. Various such conventional gravel packing techniques are described in U.S. Pat. Nos. 3,434,540; 3,708,013; 3,756,318; and 3,983,941. Such conventional gravel packing techniques have generally been successful in controlling the flow of sand from the formation into the well. In U.S. Pat. No. 3,983,941, the inside-the-casing gravel pack is formed about a slotted sand screen. In order to use such a sand screen after a typical fracturing operation with gravel packing sand, the well casing must be completely flushed of such gravel packing sand in the area of the perforation tunnels. Then, the screen can be put in place, and a conventional inside-the-casing gravel pack formed in the annular spaced about the screen and the perforation tunnels which were also cleaned out of gravel packing sand during the well casing flushing.

In U.S. Pat. No. 4,378,845, there is disclosed a special hydraulic fracturing technique which incorporates the gravel packing sand into the fracturing fluid. Normal hydraulic fracturing techniques include injecting a fracturing fluid ("frac fluid") under pressure into the surrounding formation, permitting the well to remain shut in long enough to allow decomposition or "break-back" of the cross-linked gel of the fracturing fluid, and removing the fracturing fluid to thereby stimulate production from the well. Such a fracturing method is effective at placing well sorted sand in vertically oriented fractures. The preferred sand for use in the fracturing fluid is the same sand which would have been selected, as described above, for constructing a gravel pack in the subject pay zone in accordance with prior art techniques. Normally, 20–40 mesh sand will be used; however, depending upon the nature of the particular formation to be subjected to the present treatment 40–60 or 10–20 mesh sand may be used in the fracturing fluid. The fracturing sand will be deposited around the outer surface of the borehole casing so that it covers and overlaps each borehole casing perforation. More particularly, at the fracture-borehole casing interface, the sand fill will cover and exceed the width of the casing perforations, and cover and exceed the vertical height of each perforation set. Care is also exercised to ensure that the fracturing sand deposited as the sand fill within the vertical fracture does not wash out during the flow-back and production steps. After completion of the fracturing treatment, fracture closure due to compressive earth stresses holds the fracturing sand in place.

In most reservoirs, a fracturing treatment employing 40–60 mesh gravel pack sand, as in U.S. Pat. No. 4,378,845, will prevent the migration of formation sands into the wellbore. However, in unconsolidated or loosely consolidated formations, such as a low resistivity oil or gas reservoir, clay particles or fines are also present and are attached to the formation sand grains. These clay particles or fines, sometimes called reservoir sands as distinguished from the larger diameter or coarser formation sands, are generally less than 0.1 millimeter in diameter and can comprise as much as 50% or more of the total reservoir components. Such a significant amount of clay particles or fines, being significantly smaller than the gravel packing sand, can migrate into and plug up the gravel packing sand, thereby inhibiting oil or gas production from the reservoir.

It is, therefore, an object of the present invention to provide a novel sand control method for use in producing an unconsolidated or loosely consolidated oil or gas reservoir which comprises a new and improved hydraulic fracturing of the reservoir and gravel packing both inside and outside the well casing.

SUMMARY OF THE INVENTION

In accordance with the present invention, there is provided a method for completing a well through a subterranean oil or gas reservoir. The well casing is perforated at the depth of the reservoir and a sand screen is located inside the well casing in juxtaposition with the perforation tunnels, thus forming a first annular section between the well casing and the sand screen. A fracturing fluid and a gravel packing sand are injected down the well casing into the annular section. Flow of the fracturing fluid and gravel packing sand through the sand screen tubing is inhibited, thereby forcing the fracturing fluid and gravel packing sand through the perforation tunnels in the well casing into the reservoir. Such injection continues until a vertical fracture is formed in the reservoir and the gravel packing sand has been screened out by the formation sand to the extent that the perforation tunnels and the first annular section of the casing are filled with the gravel packing sand. Injection is then terminated and production of oil or gas from the reservoir begun through the perforation tunnels and annular section into the sand screen tubing.

In a more specific aspect, a cross-over tool is located inside the well casing above the sand screen tubing, a second annular section being formed between the well casing and the cross-over tool. A gravel packer is located between the sand screen tubing and the cross-over tool and forms an isolating seal between the two annular sections. The cross-over port from the cross-over tool into the second annular section is closed, while a cross-over port in the gravel packer is open into the first annular section. Fracturing fluid and gravel packing sand are injected down the well casing through the cross-over tool and cross-over port in the gravel packer into the first annular section. The fracturing fluid is inhibited from entering the sand screen tubing and passing up the well casing by the closed cross-over port in the cross-over tool, whereby it flows through the perforation tunnels into the reservoir. When fracturing is complete and the perforation tunnels and first annular section is filled with gravel packing sand, the injection is terminated and the cross-over tool is replaced with production tubing. The reservoir is thereafter produced through the sand screen and production tubings.

DESCRIPTION OF THE PREFERRED EMBODIMENT

The present invention is concerned with a method for completing a cased and perforated well to control the production of formation sand from a fractured subterranean oil or gas reservoir. More particularly, this invention is concerned with a method for hydraulically fracturing such a reservoir and at the same time providing an inside-the-casing gravel pack for the sand production control.

Figure 1:
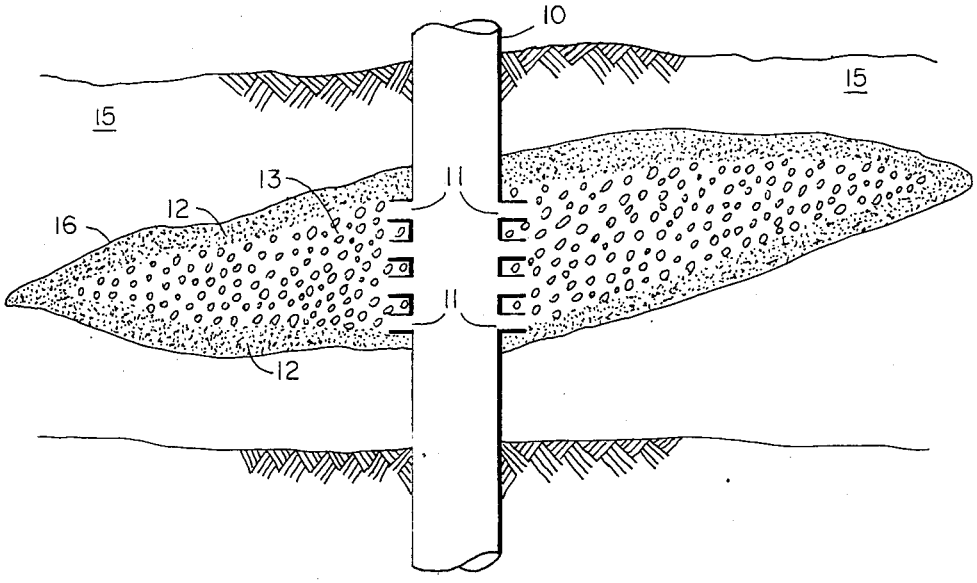
FIG. 1 is a diagrammatic view of a foreshortened, perforated well casing at a location of an unconsolidated or loosely consolidated formation, illustrating vertically aligned perforation tunnels in the well casing, vertical fractures, and fracturing sands which have been injected into the formation to create vertical fractures in accordance with the method of the present invention.

Referring now to FIG. 1, there is illustrated one embodiment of a well completion system useful in carrying out the method of the present invention. A foreshortened borehole casing 10 is disposed within a loosely consolidated or unconsolidated formation 15. The borehole casing 10 may be a conventional perforatable borehole casing, such as, for example, a cement sheathed, metal-lined borehole casing. The casing 10 is perforated to provide a plurality of perforation tunnels 11 at preselected intervals therealong. Such perforation tunnels 11 should, at each level, comprise two sets of perforations which are simultaneously formed on opposite sides of the borehole casing. These perforation tunnels 11 should have diameters between $\frac{1}{4}$ and $\frac{3}{4}$ of an inch, preferably be placed in line, and be substantially parallel to the longitudinal axis of the borehole casing.

In order to produce the desired in-line perforation, a conventional perforation gun should be properly loaded and fired simultaneously to produce all of the perforation tunnels within the formation zone to be fractured. Proper alignment of the perforation tunnels should be achieved by equally spacing an appropriate number of charges on opposite sides of a single gun. The length of the gun should be equal to the thickness of the interval to be perforated. Azimuthal orientation of the charges at firing is not critical since the initial fracture produced through the present method will leave the wellbore in the plane of the perforation tunnels. If this orientation is different from the preferred one, the fracture can be expected to bend smoothly into the preferred orientation within a few feet from the wellbore. This bending around of the fracture should not interfere with the characteristics of the completed well.

Figure 2:
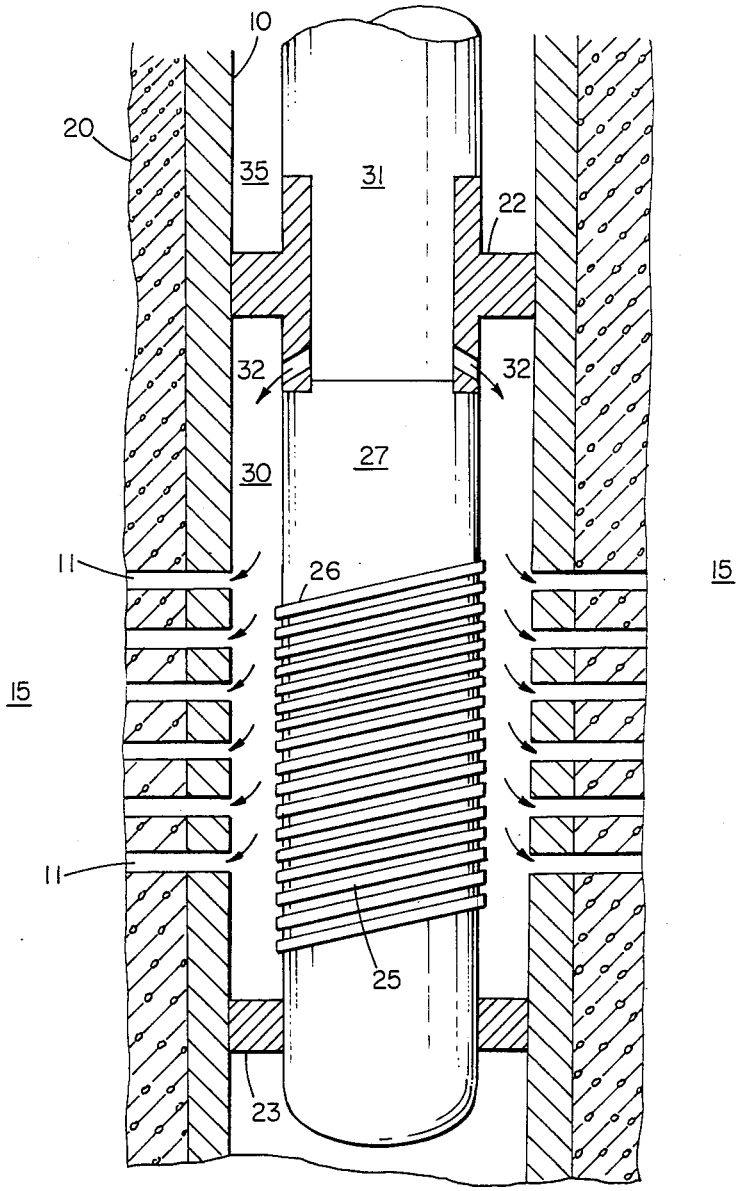
FIGS. 2 and 4 are partial cross-sectional views of a well completion tool for use inside the well casing of FIG. 1 for carrying out the formation fracturing and inside the casing gravel packing method of the present invention.

Referring now to FIG. 2, casing 10 is surrounded by a cement sheath 20. Perforation tunnels 11 are provided to extend through the casing 10 and cement sheath 20 to communicate with the subterranean formation surrounding the well casing. Gravel packers 22 and 23 are set inside the casing 10 to isolate that portion of the well casing containing perforation tunnels 11. A sand screen 25 is located inside casing 10 and in juxtaposition with the perforated tunnels 11. The purpose of the sand screen 25 is to allow fluid flow from the formation while preventing the movement of sand and gravel. Sand screen 25 comprises a continuous wrapping of wire ribbon 26 on the blank pipe 27. Slots or holes (not shown) are first cut or drilled in the pipe to allow fluid flow. Metal ribs (not shown) are welded longitudinally on the outside of the pipe. Then the wire ribbon is wrapped around the metal ribs in a helical pattern. The wire ribbon is welded to each rib. This type of sand screen is conventional in the industry.

Sand screens generally are manufactured in lengths of 30 feet or less, corresponding to one joint of pipe. Spacing between the wire ribbons in the wire wrap depends on the sand or gravel size whose movement is to be prohibited. If 20/40 mesh gravel is used, then a spacing of about 0.012 inch is typical. For 40/60 mesh gravel, a spacing of about 0.008 inch is typical. At least one inch of radial clearance is desirable between the sand screen and the casing 10. The blank pipe 27 usually extends above the wire ribbons 26.

The sand screen 25 is supported from a conventional gravel packer 22. Such a gravel packer serves two purposes. It controls the path of flow of the fracturing fluid and gravel packing sand into the annular section 30 from a conventional cross-over tool 31 through the cross-over ports 32 and 33 during hydraulic fracturing and gravel packing and, along with the gravel packer 23, forms an isolating seal for the annular section 30 during oil or gas production from the fractured reservoir.

Figure 4:
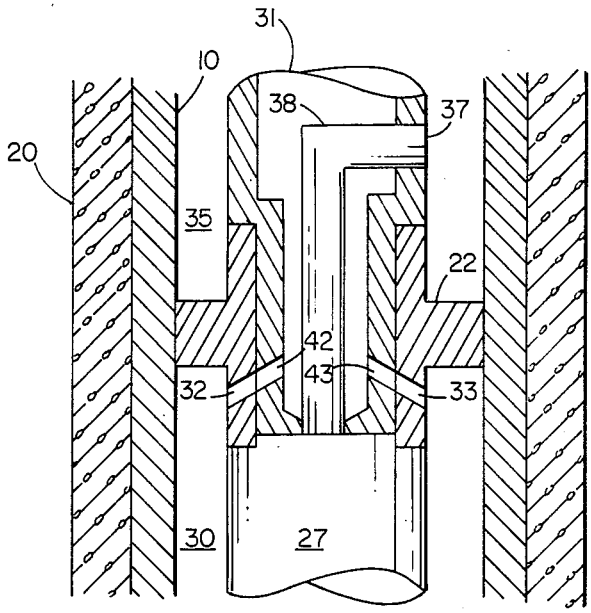

Having now described one embodiment of a well completion tool useful in carrying out the method of the present invention, the use of such a tool will now be described in conjunction with the hydraulic fracturing and gravel packing method of the present invention. Initially, the borehole casing 10 is cemented in place and perforated at preselected intervals to form at least one set of longitudinal, in-line perforation tunnels 11. The sand screen 25 is located inside such casing and in juxtaposition with the perforation tunnels 11 as shown in FIG. 2. Sand screen 25 is held in position by the gravel packer 22 and the sealed annular section 30 is provided between the two gravel packers 22 and 23. Referring now to FIG. 4 a fracturing fluid is injected down the well casing through a work string (not shown) into the cross-over tool 31. This fluid passes through the cross-over ports 42 and 43 in the cross-over tool 31, which are in fluid communication with the cross-over ports 32 and 33 in the gravel packer 22 and then into the annular section 30. The conventional cross-over port 37 from the wash pipe 38 of cross-over tool 31 into the annular section 35 above the gravel packer 22 is closed so as to inhibit the flow of fracturing fluid from annular section 30 through the sand screen 25 and upward through the cross-over tool 31 into the annular section 35. Consequently, all the fracturing fluid is forced out the perforation tunnels 11 into the surrounding reservoir 15.

This reservoir, under the hydraulic pressure of the fracturing fluid, will be fractured such that the oil or gas production inflow will be linear into the fracture as opposed to radial into the well casing. From a fluid flow standpoint, there is a certain production fluid velocity required to carry fines toward the fracture face. Those fines located a few feet away from the fracture face will be left undisturbed during production since the fluid velocity at the distance from the fracture face is not sufficient to move the fines. However, fluid velocity increases as it linearly approaches the fracture and eventually is sufficient to move fines located near the fracture face into the fracture. Such fines near the fracture faces need to be stabilized to make sure they adhere to the formation sand grains and don't move into the fracture as fluid velocity increases. Prior stabilization procedures have only been concerned with radial production flow into the well casing which would plug the perforations in the casing. Consequently, stabilization was only needed within a few feet around the well casing. In an unconsolidated sand formation, such fines can be 30%–50% or more of the total formation constituency, which can pose quite a sand control problem. Stabilization is, therefore, needed a sufficient distance from the fracture face along the entire fracture line so that as the fluid velocity increases toward the fracture there won't be a sand control problem.

Figure 3:
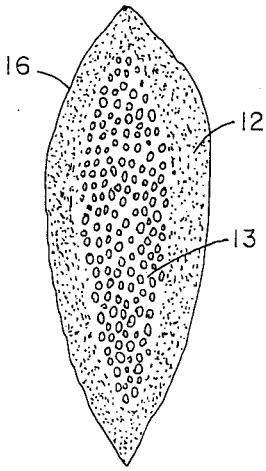
FIG. 3 is a cross-sectional end view of the formation fracture of FIG. 1.

Initially, a fracture fluid containing an organic clay stabilizing agent may be injected through the well casing perforation tunnels 11 into the formation 15. Such a stabilizing agent adheres the clay particles or fines to the coarser sand grains. In the same fracturing fluid injection, or in a second injection step, a very small mesh gravel packing sand, such as 100 mesh, is injected. As fracturing continues, the small mesh sand will be pushed up against the fractured formation's face 16 to form a layer 12, as illustrated in FIG. 1. Thereafter, a proppant injection step fills the fracture with a larger mesh gravel packing sand, preferably 40–60, mesh to form a layer 13. A cross-sectional end view of the reservoir fracture is shown in FIG. 3. It has been conventional practice to use such a 40–60 mesh sand for gravel packing. However, for low resistivity unconsolidated or loosely consolidated sands, a conventional 40–60 mesh gravel pack will not hold out the fines. The combination of a 100 mesh sand layer up against the fracture face and the 40–60 proppant sand layer makes a very fine grain gravel filter that will hold out such fines. As oil or gas production is carried out from the reservoir, the 100 mesh layer sand will be held against the formation face by the 40–60 mesh proppant layer and won't be displaced, thereby providing for such a very fine grain gravel filter at the formation face. Fluid injection with the 40–60 mesh proppant fills the fracture and a point of screen out is reached at which the gravel pack comes all the way through the perforation tunnels 11 and fills the annular section 30 surrounding the sand screen tubing 27. The fracturing treatment of the invention is now completed and oil or gas production may now be immediately carried out by removal of the cross-over tool 31 and replacement with conventional producing tubing since the sand screen 25 is already in place. This eliminates the time-consuming and costly conventional prior art steps of cleaning out the well casing, inserting the sand screen 25, and completing an inside-the-casing gravel pack.

Figure 5:
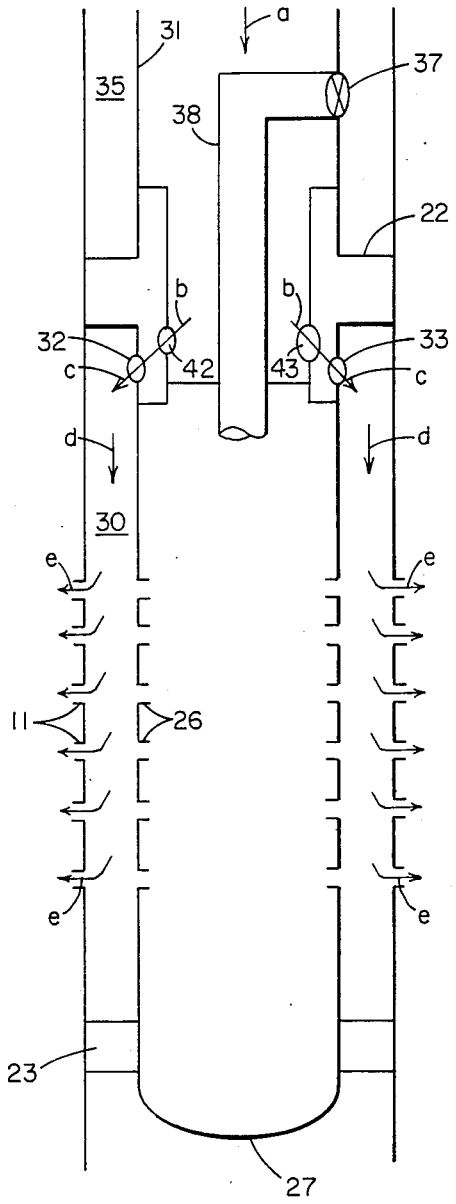
FIGS. 5 and 6 are diagrammatic fluid flow patterns through the well completion tool of FIGS. 2 and 4 for the different phase of the present invention.
Figure 6:
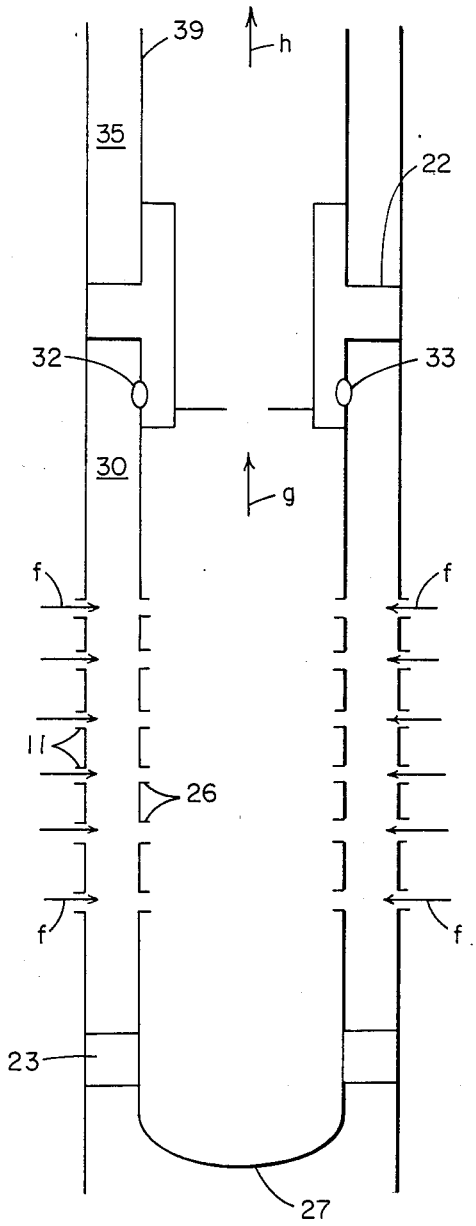

The foregoing described fluid flow may be more fully understood by reference to the diagrammatic fluid flow patterns shown in FIGS. 5 and 6. Referring firstly to FIG. 5, the arrows a–e illustrate fluid flow paths during the hydraulic fracturing and gravel packing phase of the present invention. These fluid flow paths are as follows:

a: down the cross-over tool 31,
b: through open cross-over ports 42 and 43 of cross-over tool 31,
c: through open cross-over ports 32 and 33 of gravel packer 22,
d: through annular section 30, and
e: through perforations 11 into the formation.

This fracturing fluid will also pass through the sand screen 25 and into the wash pipe 38, but will not flow into the annulus 35 due to the closed cross-over port 37 in the cross-over tool 31.

Referring now to FIG. 6, the arrows of f–h illustrate the fluid flow paths during the production phase of the present invention as follows:

f: through the perforation 11 into annular section 30,
g: through the sand screen 25 and up the pipe 27,
h: through the production tubing 39 to the surface of the earth.

Having briefly described the hydraulic fracturing and gravel packing method of the invention for increasing sand control, a more detailed description of an actual field operation employed for carrying out such method will now be set forth. Reference to Tables I and II will aid in the understanding of the actual field operation. Initially, as shown in step 1 in Table I, 7,500 gallons of a 2% KCl solution containing 1% by volume of a clay stabilizer, such as Western's Clay Master 3 or B. J. Hughes' Claytrol, is injected into the reservoir. For a 40-foot fracture height, about 187.5 gallons of clay stabilizing material was used per foot of formation radially from the well casing pumped at a rate of 20 barrels per minute so as to provide as wide a fracture as possible. This contrasts with conventional gravel packing techniques of using clay stabilizing agents to treat the formation outward of one to two feet from the wellbore with about 25–50 gallons per foot at a much lower pumping rate.

In step 2, 5,000 gallons of fracturing fluid was injected having a 50 lb./1,000 gal. cross-linked HPG in water containing 2% KCl, 20 lb./1,000 gal. fine particle oil soluble resin and 1 lb./gal 100 mesh sand.

In steps 3–7, 43,500 lbs. of 40–60 mesh sand proppant is incrementally added with 11,500 gallons of fracturing fluid. During the final 500 gallons of fluid injection, the cross-linker was eliminated and the pumping rate reduced to 5 barrels per minute.

In step 8, no further proppant was added and the fracture was flushed with 1,600 gallons of 2% KCl water. In each of steps 2–8, the injection fluid contained a 1% by volume of the organic clay stabilizing agent.

The final stage of the fracturing treatment was designed to the point of screen out, leaving the perforation tunnels 11 and annular section 30 inside the well casing filled with the gravel pack. At this point, injection was continued until 7,500 gallons of fluid containing 2% KCl water and organic clay stabilizing agent had been displaced into the fracture. Finally, the KCl water was displaced with a $ZnBr_2$ weighted fluid.

Following the fracturing treatment, the well was opened to oil or gas flow from the reservoir.

TABLE I

| | Fracturing Treatment | |
|---|---|---|
| Step No. | Fluid Vol. (Gals.) Incremental | Proppant (Lbs.) Incremental |
| 1 | 7500 | 0 |
| 2 | 5000 | 0 |
| 3 | 2500 | 2500 |
| 4 | 2500 | 5000 |
| 5 | 3000 | 12000 |
| 6 | 2000 | 12000 |
| 7 | 1500 | 12000 |
| 8 | 1600 | 0 |

Note: Pump rate = 20 BPM and Proppant = 40/60 mesh sand.

TABLE II

| | Treatment Volumes & Materials |
|---|---|
| Step 1: | 7500 gals. Maxi-Pad containing per 1000 gals.: |
| | 170 lbs. KCl (2%) |
| | 3 gals. Clay Master 3 (clay stabilizer) |
| | 2 gals. Flo-Back 10 |
| Step 2: | 5000 gals. Apollo-50 containing per 1000 gals.: |
| | 170 lbs. KCl |
| | 3 gals. Clay Master 3 |
| | 2 gals. Flo-Back 10 |
| | 0.25 gals. Frac-Cide 2 (bacteria) |
| | 20 lbs. Frac Seal |
| Steps 3–7: | 11,500 gals Apollo-50 containing per 1000 gals.: |
| | 170 lbs. KCl |
| | 3 gals. Clay Master 3 |
| | 2 gals. Flow-Back 10 |
| | 0.25 gals. Frac-Cide 2 |
| | 20 lbs. Frac-Seal |
| | 0.5 lbs. B-5 (breaker) |
| Step 8: | 1600 gals. of same fluid as steps 3–7 |
| Flush step: | 7500 gals. fresh water containing per 1000 gals.: |
| | 170 lbs. KCl |
| | 3 gals. Clay Master 3 |
| | 2 gals. Flo-Back 10 |
| | 10 lbs. J-12 (gelling agent) |

While separate injection steps have been described and set forth in conjunction with Table II for the injections of fracturing fluid and gravel packing sands, these injections may take place simultaneously or in selective combinations as desirable for a particular reservoir.

In order to achieve the desired reservoir fracturing, the size and inclination of the cross-over ports 32 and 33 of gravel packer 22 must be sufficient to permit the pumping of fracturing fluid at a fluid pressure sufficient to achieve hydraulic fracturing. The fluid pressure drop across the cross-over ports should not inhibit such hydraulic fracturing. In one embodiment, the diameters of the cross-over ports are at least one inch, and preferably in the range of one to two inches. The inclination of the cross-over ports is at least 10 degrees from the vertical axis of the gravel packer, and preferably in the range of 10 to 90 degrees.

Having now described the hydraulic fracturing and gravel packing method of the present invention for use in sand control during oil and gas production from a subterranean reservoir, it is to be understood that various modifications or alterations may become apparent to one skilled in the art without departing from the spirit and scope of the invention as set forth in the appended claims.

I claim:

1. A method for completing a well that penetrates a subterranean oil or gas reservoir, comprising:

(a) providing a borehole casing through said reservoir, (b) perforating said casing at preselected intervals therealong to form at least one set of longitudinal, in-line perforation tunnels, (c) locating a sand screen inside the casing and in juxtaposition with said perforation tunnels, a first annular section being formed between said sand screen and said casing, (d) locating a cross-over tool, having a first cross-over port, inside said casing and above said sand screen, a second annular section being formed between said cross-over tool and said casing, (e) locating a gravel packer, having a second cross-over port, inside said casing so as to form an isolating seal between said first and second annular sections, said second cross-over port being in fluid communication with said first cross-over port, (f) opening said first cross-over port in said cross-over tool and opening said second cross-over port in said gravel packing tool, (g) injecting a fracturing fluid containing a gravel packing sand down through said cross-over tool and out through said first and second cross-over ports into said first annular section, whereby said fracturing fluid is forced out of said first annular section through said perforation tunnels into said reservoir, (h) terminating the injection of said fracturing fluid when a vertical fracture communicating with said casing has been formed in said reservoir and said gravel packing sand has been screened out by the formation sand of said reservoir to the extent that said perforation tunnels and said first annular section of said casing are packed with said gravel packing sand, (i) removing said cross-over tool from inside said casing, (j) placing a producing tubing into said casing in fluid communication with said sand screen tubing, and (k) producing said oil or gas reservoir through said gravel packing sand and upward through said well casing by way of said sand screen and said production tubing.

2. The method of claim 1 wherein the size and inclination of said first and second cross-over ports permit the pumping of said fracturing fluid at a fluid pressure sufficient to achieve hydraulic fracturing of said reservoir.

3. The method of claim 2 wherein the pressure drop of the fracturing fluid across said first and second cross-over ports does not inhibit the hydraulic fracturing of said reservoir.

4. The method of claim 2 wherein the diameters of said first and second cross-over ports are at least one inch.

5. The method of claim 4 wherein the diameters of said first and second cross-over ports are in the range of one to two inches.

6. The method of claim 2 wherein the inclinations of said first and second cross-over ports are at least 10 degrees from the vertical axis of said gravel packer.

7. The method of claim 6 wherein the inclinations of said first and second cross-over ports are in the range of 10 to 90 degrees from the vertical axis of said gravel packer.

8. The method of claim 2 wherein said fracturing fluid is pumped at a rate of at least 10 barrels per minute and at least 20 gallons per foot of reservoir.

9. The method of claim 2 wherein said fracturing fluid is pumped at a rate of about 20 barrels per minute and about 500 gallons per foot of reservoir.

* * * * *